US010207777B2

(12) United States Patent
McCormick

(10) Patent No.: US 10,207,777 B2
(45) Date of Patent: Feb. 19, 2019

(54) RETRACTABLE PONTOONS

(71) Applicant: Thomas B. McCormick, St. George, UT (US)

(72) Inventor: Thomas B. McCormick, St. George, UT (US)

( * ) Notice: Subject to any disclaimer, the term of this patent is extended or adjusted under 35 U.S.C. 154(b) by 0 days.

(21) Appl. No.: 15/981,773

(22) Filed: May 16, 2018

(65) Prior Publication Data

US 2018/0334226 A1 Nov. 22, 2018

Related U.S. Application Data

(60) Provisional application No. 62/506,812, filed on May 16, 2017.

(51) Int. Cl.
*B63B 1/00* (2006.01)
*B63B 35/36* (2006.01)
*B63B 35/38* (2006.01)

(52) U.S. Cl.
CPC ..... *B63B 35/36* (2013.01); *B63B 35/38* (2013.01)

(58) Field of Classification Search
CPC .. B63B 1/10; B63B 1/12; B63B 1/121; B63B 1/14; B63B 2001/10; B63B 2001/12; B63B 2001/121; B63B 2001/123; B63B 2001/14; B63B 2001/142; B63B 7/00; B63B 7/02; B63B 2007/00; B63B 2007/03; B63B 35/34; B63B 35/36; B63B 35/38
USPC ..... 114/61.1, 61.14, 61.15, 61.16, 61.17, 114/61.18, 61.19, 292
See application file for complete search history.

(56) References Cited

U.S. PATENT DOCUMENTS 6,095,079 A * 8/2000 Smidt ..... B63B 1/12 114/353
6,564,735 B1 * 5/2003 Jackson ..... B63B 35/36 114/353
9,611,008 B1 * 4/2017 O'Neal ..... B63B 1/14
9,944,354 B1 * 4/2018 O'Neal ..... B63B 1/14
2014/0165893 A1 * 6/2014 O'Neal ..... B63B 1/14 114/61.15

* cited by examiner

*Primary Examiner* — Daniel V Venne
(74) *Attorney, Agent, or Firm* — Gurr Brande & Spendlove, PLLC; Robert A. Gurr

(57) ABSTRACT

A retractable pontoon boat has a deck, a starboard pontoon and a port pontoon, a center beam coupled to the underside of the deck and running substantially from bow to stern, a plurality of pivoting arms coupling the pontoons to the center beam, a plurality of bearings interposed between the deck and the pivoting arms, and one or more linear actuators for actuating the pivoting arms; wherein, in a first, retracted position, the pontoons are substantially underneath the deck; and wherein, in a second, extended position, the pontoons are substantially extended from underneath the deck.

4 Claims, 6 Drawing Sheets

RETRACTABLE PONTOONS

CROSS-REFERENCE TO RELATED APPLICATIONS

This application claims the benefit of U.S. Provisional Application Ser. No. 62/506,812, filed on May 16, 2017, which is incorporated herein by reference.

TECHNICAL FIELD

The present disclosure relates to watercrafts. More particularly, the present disclosure relates to retractable pontoons on boats.

BACKGROUND

Pontoon boats have several benefits over deck boats. For example, unlike the V-shaped hull of deck boats, pontoon boats typically have an aluminum tube (a pontoon) at each side of the deck. This creates additional stability not found in deck boats. As such, it will be appreciated that the wider the pontoons, the greater the stability. However, if the pontoons are too wide, the boat becomes difficult to both transport and store. Accordingly, several adjustable-width pontoon boats have been developed in the art. For example, U.S. Pat. Nos. 9,156,526, 8,820,255, 6,298,802, 6,647,913, 6,003,458, and 6,874,440 are directed towards adjustable pontoons. However, in each instance, the pontoons extend laterally from the longitudinal axis of the deck. Further, the deck portion in each disclosure likewise adjusts. Requiring the deck to likewise adjust unnecessarily complicates the matter and increases cost. Further, an adjustable deck causes additional components, which adds fail points and liabilities. Further, because the deck position changes, the configuration of components thereon, and the storage of user items thereon, is dependent upon the deck fold points, which limits user customization.

Therefore, there remains a need for a pontoon boat that is width-extendable, that does not require extension of the deck, and that more easily adjusts the pontoons. The present disclosure seeks to solve these and other problems.

SUMMARY OF EXAMPLE EMBODIMENTS

In one embodiment, a retractable pontoon boat comprises a deck; a starboard pontoon and a port pontoon; a center beam coupled to the underside of the deck and running substantially from bow to stern; a plurality of pivoting arms coupling the pontoons to the center beam; a plurality of bearings interposed between the deck and the pivoting arms; and one or more linear actuators for actuating the pivoting arms; wherein, in a first, retracted position, the pontoons are substantially underneath the deck; and wherein, in a second, extended position, the pontoons are substantially extended from underneath the deck.

In one embodiment, a retractable pontoon boat comprises a deck; a starboard pontoon and a port pontoon; a plurality of pivoting arms interposed between the starboard pontoon and port pontoon, the pivoting arms pivotably coupled to the deck at a center position; a plurality of bearings interposed between the deck and the pivoting arms; and one or more linear actuators for actuating the pivoting arms; wherein, in a first, retracted position, the pontoons are substantially underneath the deck with the port pontoon extended from the stern and the starboard pontoon extended from the bow; and wherein, in a second, extended position, the pontoons are substantially extended from underneath the deck.

DETAILED DESCRIPTION OF EXAMPLE EMBODIMENTS

Figure 1:
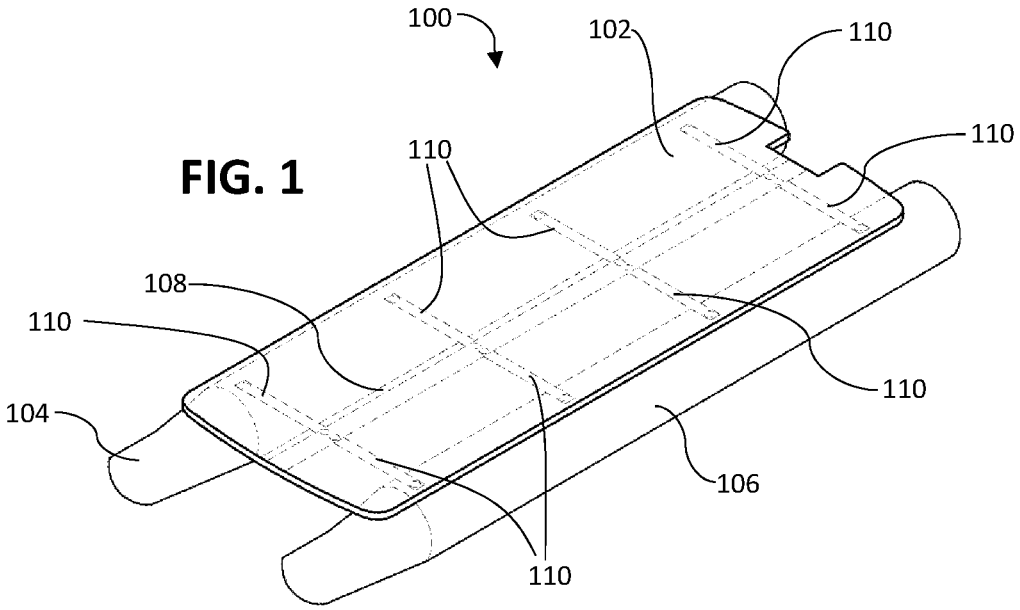
FIG. 1 illustrates a perspective view of an adjustable pontoon boat with the pontoons extended.
Figure 2:
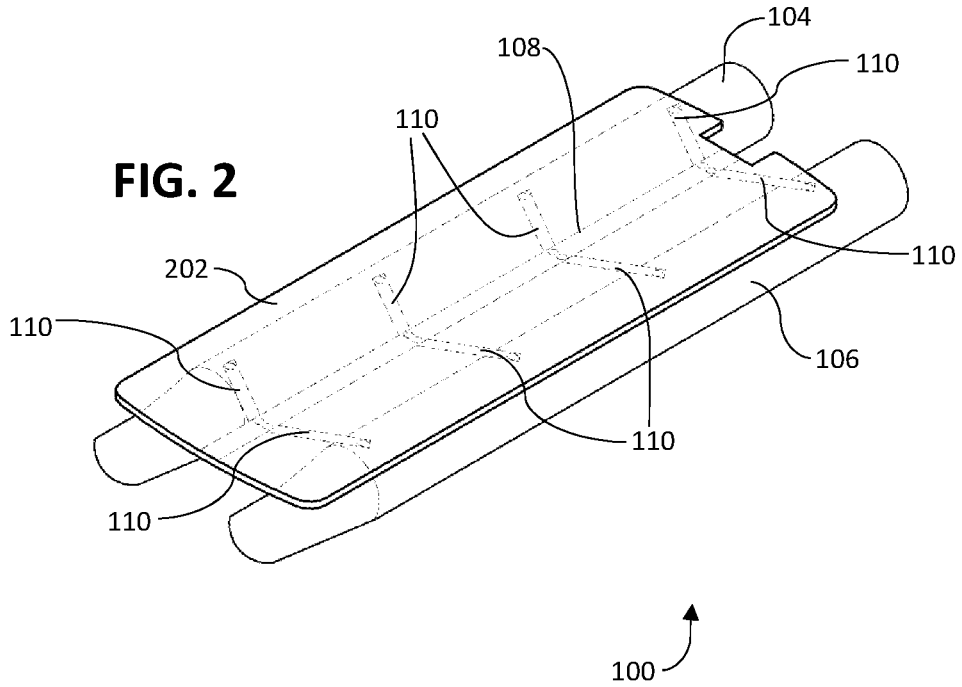
FIG. 2 illustrates a perspective view of an adjustable pontoon boat with the pontoons retracted.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As previously discussed, there is a need for a pontoon boat that can be easily transported and stored, that can be widened and stable on the water, and that does not require the deck to extend. The retractable pontoon boat shown and described herein solves these needs and others.

Figure 3:
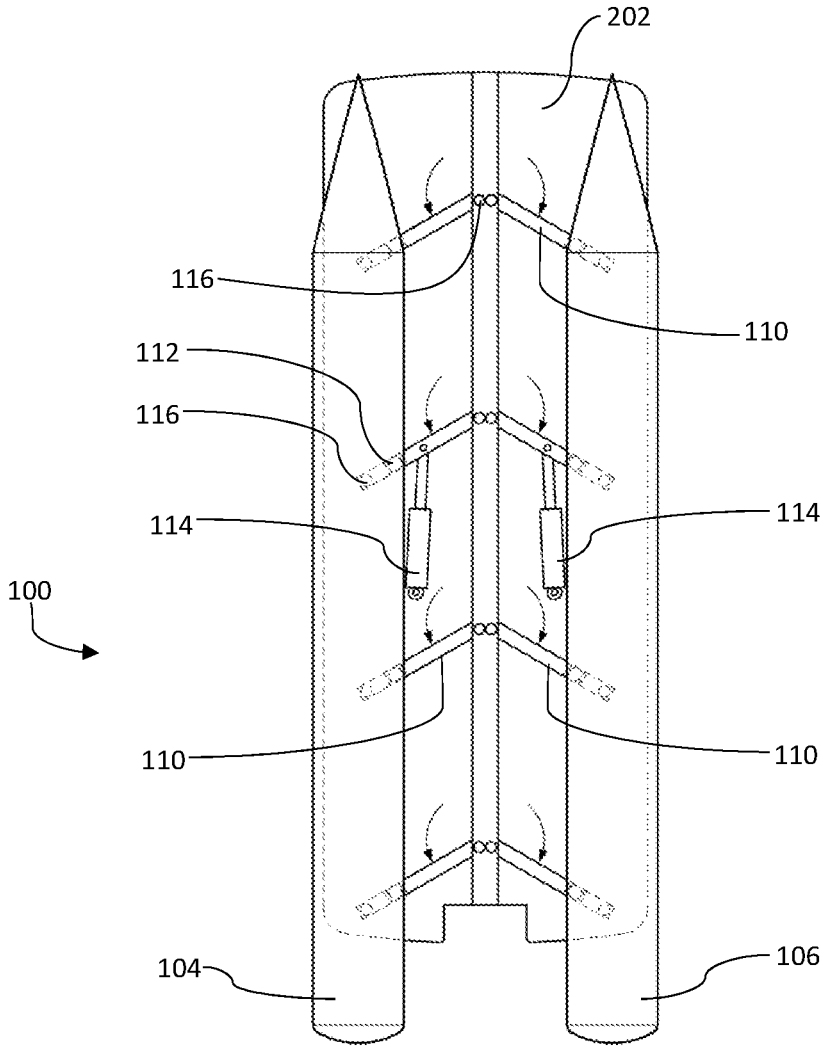
FIG. 3 illustrates a bottom plan view of an adjustable pontoon boat with the pontoons retracted.
Figure 4:
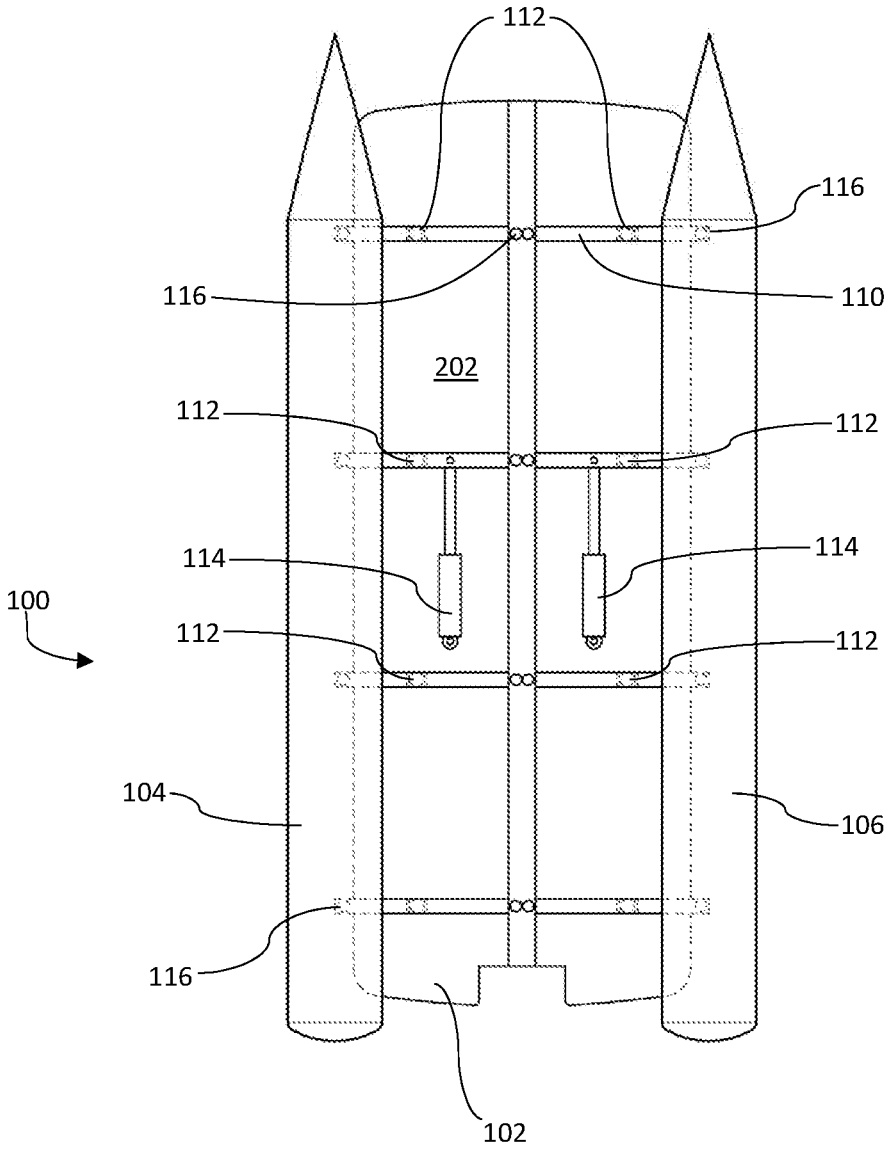
FIG. 4 illustrates a bottom plan view of an adjustable pontoon boat with the pontoons extended.
Figure 5:
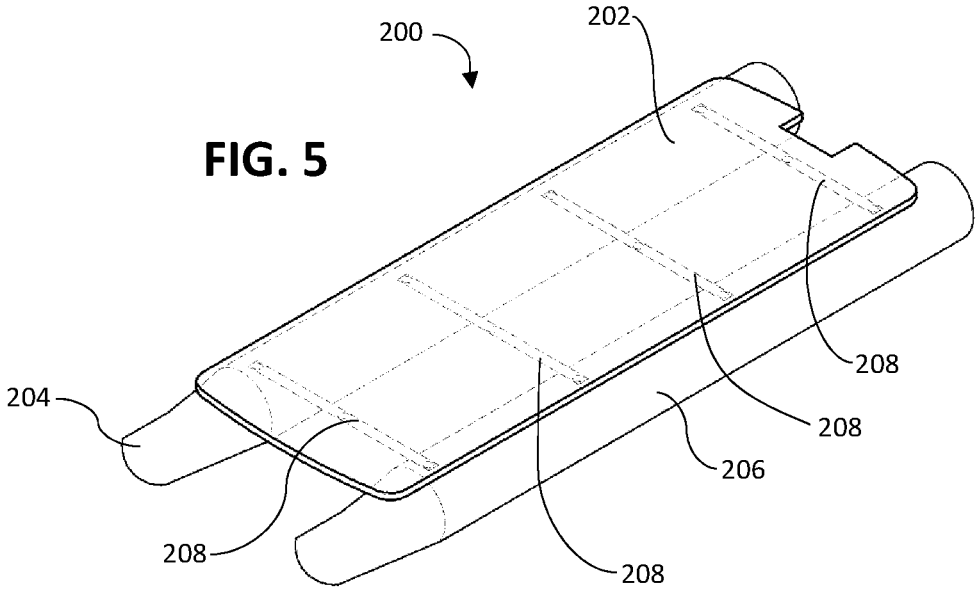
FIG. 5 illustrates a perspective view of an adjustable pontoon boat with the pontoons extended.
Figure 6:
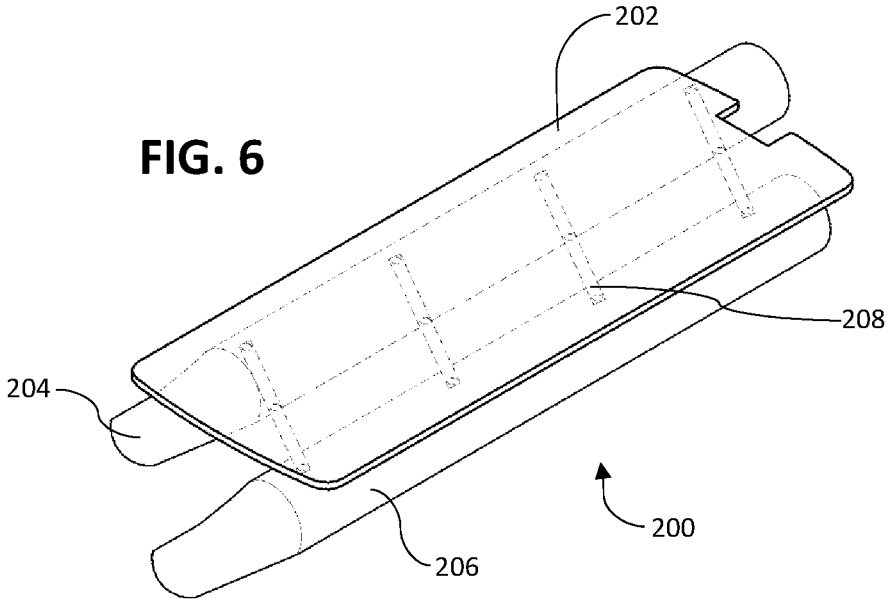
FIG. 6 illustrates a perspective view of an adjustable pontoon boat with the pontoons retracted.

In one embodiment, as shown in FIGS. 1-4, a retractable pontoon boat 100 comprises a deck 102, a starboard pontoon 104 and a port pontoon 106, a center beam 108 coupled to the underside of the deck 102 and running substantially from bow to stern, a plurality of pivoting arms 110 coupling the pontoons 104, 106 to the center beam 108, a plurality of bearings 112 (as best seen in FIGS. 3-4) interposed between the deck 102 and the pivoting arms 110, and one or more linear actuators 114 for actuating the pivoting arms 110. Each pivoting arm 110 is pivotably coupled to a pontoon on a first end and the center beam 108 on the opposite end. Any number of mechanisms may be used to provide for pivotable coupling, such as a ball and socket joint 116, bearings, curved tongue and groove arrangements, or other mechanisms. Accordingly, in a first, retracted position, as shown in FIG. 3, the pontoons 104, 106 are substantially underneath the deck 102. In a second, extended position, as shown in FIG. 4, the pontoons 104, 106 are substantially extended from underneath the deck 102. It will further be appreciated that, depending upon the length of the pivoting arms 110, the pontoons 104, 106 may be fully-retracted beneath the deck 102 and may also be fully-extended beyond the port and starboard sides of the deck 102. Further, while bearings 112 are used to allow the pivoting arms to maneuver smoothly on the underside of the deck 102, they are not required. In one configuration, the pivoting arms 110 do not have direct contact with the deck 102, resulting from the positioning of the ball and socket joints 116, so bearings 112 are not needed.

Therefore, when in the retracted position, as shown in FIG. 3, the linear actuators 114 are in a first, retracted position. When a user actuates the linear actuators, which may be electronically controlled, the linear actuators 114 extend, which forces the pivoting arms 110 toward the bow and perpendicular to the center beam 108, as shown in FIG. 4, thus extending the pontoons substantially from under the deck 102. It will be appreciated that the linear actuators 114 may be placed in any number of locations and directions in relation to the plurality of pivoting arms 110, and that any number of linear actuators may be used. Further, the linear actuators may be of any type known in the art, such as gearmotor driven or hydraulically driven. Further, while linear actuators are shown, other methods of actuating the pivoting arms 110 are contemplated. For example, any number of drive mechanisms, such as chain drives may be used, along with any number of motor driven cable and pulley systems, and other methods.

Figure 7:
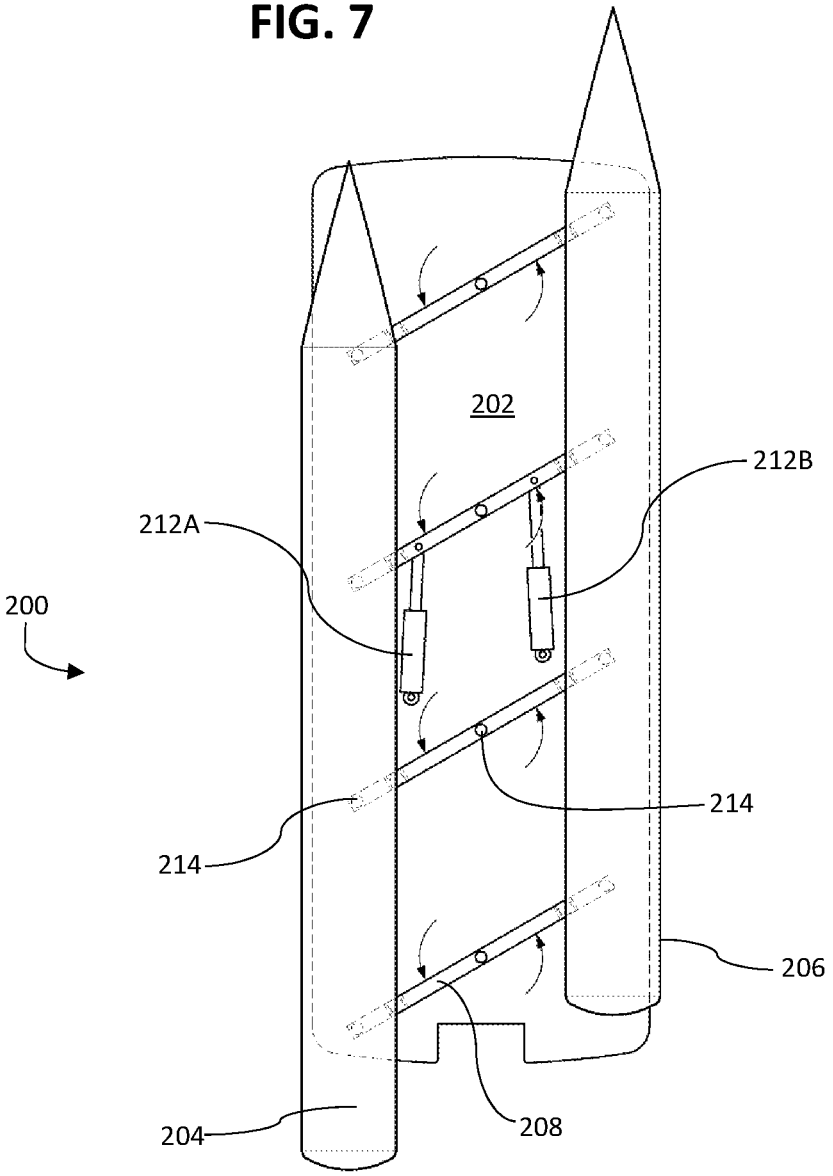
FIG. 7 illustrates a bottom plan view of an adjustable pontoon boat with the pontoons retracted.
Figure 8:
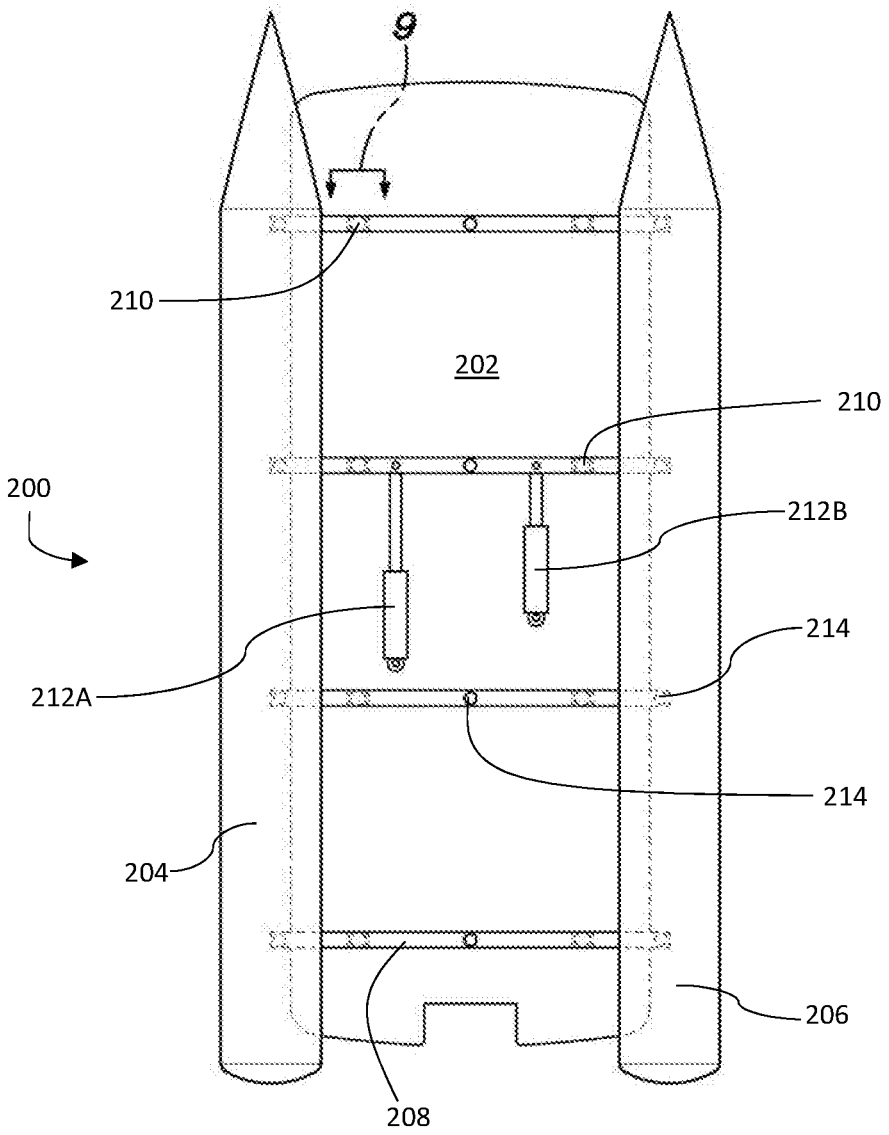
FIG. 8 illustrates a bottom plan view of an adjustable pontoon boat with the pontoons extended.
Figure 9:
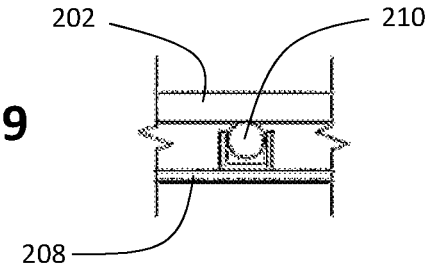
FIG. 9 illustrates a detailed view of a bearing of an adjustable pontoon boat.

In one embodiment, as shown in FIGS. 5-9, a retractable pontoon boat 200 comprises a deck 202, a starboard pontoon 204 and a port pontoon 206, a plurality of pivoting arms 208 interposed between, and directly coupling, the starboard pontoon 204 and port pontoon 206, the pivoting arms 208 pivotably coupled to the deck 202 at a center position, a plurality of bearings 210 (as best seen in FIGS. 7-9) interposed between the deck 202 and the pivoting arms 208, and one or more linear actuators 212A-B for actuating the pivoting arms 208. Because the pivoting arms 208 are of single manufacture, and directly couple the starboard pontoon 204 to the port pontoon 206, pivoting of the pivoting arms 208 causes the starboard pontoon 204 to move in a direction opposite of the port pontoon 206. For example, in a first, retracted position as shown in FIG. 7, the pontoons 204, 206 are substantially underneath the deck 202 with the port pontoon 206 extended from the bow and the starboard pontoon 204 extended from the stern. In this configuration, the starboard-side linear actuator 212A is retracted while the port-side linear actuator 212B is extended. In a second, extended position as shown in FIG. 8, the pontoons 204, 206 are substantially extended from underneath the deck, with the pivoting arms 208 being perpendicular to the longitudinal axis of the deck 202. In this configuration, the starboard-side linear actuator 212A is extended while the port-side linear actuator 212B is retracted. While the linear actuators 212A-B are shown as being on the stern side of the pivoting arm 208, such configuration is not required. In an alternate embodiment, one linear actuator may be coupled on a stern side of a pivoting arm 208 while a second linear actuator may be positioned on the bow side. Further, as previously discussed, linear actuators are not required, and other mechanisms for pivoting the pivoting arms 208 may be used, such as cable systems (e.g., winch), screw-driven systems, or any number of mechanisms. Bearings (or casters) 210 allow the pivoting arms 208 to maneuver smoothly on the underside of the deck 202, as well as provide additional stability to the deck 202 and pivoting arms 208. As discussed earlier, the pivoting arms may be coupled to the pontoons 204, 208 and deck 202 using any number of pivotable mechanisms, such as a ball and socket configuration 214.

In one example of use, a user would store, and travel with, the pontoon boat 100 in the first, retracted position as shown in FIG. 3. Upon arrival at a body of water, a user would launch the pontoon boat 100 into the water. The user would then extend the pontoons 104, 106 from underneath the deck 102 of the pontoon boat 100 by actuating the linear actuators 114 to arrive at a second, extended position as shown in FIG. 4. By extending the pontoons 104, 106, the pontoon boat 100 experiences additional stability upon the water. Because the deck 102 does not change configurations, a user may be present on the deck, along with his/her belongings, while extending the pontoons 104, 106. When a user desires to re-trailer the pontoon boat 100, the user would simply retract the pontoons 104, 106 by actuating the linear actuators 114 in a reverse direction, and then trailer the pontoon boat 100.

It is appreciated from the foregoing that the retractable pontoon boat described herein solves the need for a pontoon boat that can be easily transported and stored, that can be widened and stable on the water, and that does not require the deck to move. Moreover, because the adjusting arms are of single manufacture and not telescopic in nature, structural integrity is increased, and the failure rate of components decreases. In other words, individual bearings or casters are easier to replace and are less costly than the telescoping arms in the prior art. Accordingly, the retractable pontoon boat disclosed herein is an improvement over the prior art.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. A retractable pontoon boat, comprising:

a deck;

a starboard pontoon and a port pontoon;

a center beam coupled to the underside of the deck and running substantially from bow to stern;

a plurality of pivoting arms coupling the pontoons to the center beam;

a plurality of bearings interposed between the deck and the pivoting arms; and one or more linear actuators for actuating the pivoting arms;

wherein, in a first, retracted position, the pontoons are substantially underneath the deck and the pivoting arms are angled in relation to the center beam; and wherein, in a second, extended position, the pontoons are substantially extended from underneath the deck and the pivoting arms are perpendicular to the center beam.

2. The retractable pontoon boat of claim 1, wherein the pivoting arms pivot rearwardly towards the stern to retract the pontoons, the pontoons retracting in a non-linear motion to a first position beneath the deck.

3. A retractable pontoon boat, comprising:

a deck;

a starboard pontoon and a port pontoon;

a plurality of pivoting arms interposed between the starboard pontoon and port pontoon, the pivoting arms pivotably coupled to the deck at a center position;

a plurality of bearings interposed between the deck and the pivoting arms; and one or more linear actuators for actuating the pivoting arms;

wherein, in a first, retracted position, the pontoons are substantially underneath the deck with the port pontoon extended from the stern and the starboard pontoon extended from the bow; and wherein, in a second, extended position, the pontoons are substantially extended from underneath the deck on the port and starboard sides.

4. The retractable pontoon boat of claim 3, wherein the pontoons pivot in a non-linear motion.

* * * * *